US008405289B2

(12) United States Patent
Chang

(10) Patent No.: US 8,405,289 B2
(45) Date of Patent: Mar. 26, 2013

(54) LED ILLUMINATING DEVICE

(75) Inventor: Shao-Han Chang, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 134 days.

(21) Appl. No.: 13/070,451

(22) Filed: Mar. 23, 2011

(65) Prior Publication Data

US 2012/0013251 A1 Jan. 19, 2012

(30) Foreign Application Priority Data

Jul. 15, 2010 (CN) ..... 2010 1 0226828

(51) Int. Cl.
*H01J 1/02* (2006.01)

(52) U.S. Cl. ..... 313/46; 362/373

(58) Field of Classification Search ..... 313/46, 313/498, 512; 315/112; 362/373, 294, 264
See application file for complete search history.

(56) References Cited

U.S. PATENT DOCUMENTS

2011/0148271 A1* 6/2011 Wang et al. ..... 313/46
2012/0212129 A9* 8/2012 Chou et al. ..... 315/35

FOREIGN PATENT DOCUMENTS

CN 101118052 A 2/2008

* cited by examiner

*Primary Examiner* — Anne Hines
(74) *Attorney, Agent, or Firm* — Altis Law Group, Inc.

(57) ABSTRACT

An LED illuminating device includes a hollow housing including an open end and a closed end opposite to the open end, an LED substrate, a connector, a base held inside the housing; and a driving circuit accommodated in the base. A number of first vents are arranged on the lateral surface of the housing adjacent to the closing end, a number of second air vents are arranged on the lateral surface of the housing adjacent to the open end, and a space is formed between the surface of the base and the inner wall of the housing and communicated with the first vents and the second vents.

8 Claims, 5 Drawing Sheets

LED ILLUMINATING DEVICE

BACKGROUND

1. Technical Field

The present disclosure relates to light emitting diode (LED) illuminating devices and, particularly, to an LED illuminating device with heat dissipation module.

2. Description of Related Art

Compared to traditional light sources, LEDs have advantages, such as high luminous efficiency, low power consumption, and long service life. To dissipate heat from LED lamps, a type of heat sink called "sunflower heat sink" is often used in LED lamps having a plurality of LEDs. The sunflower heat sink has a post-shaped conductive member and a plurality of fins extending outwardly and radially from a lateral surface of the conductive member. One problem with this type of LED illuminating devices is its large size and heavy weight. In addition, dust tends to cumulate in the spaces between the fins, which affects heat dissipation.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Embodiments of the present disclosure are now described in detail, with reference to the accompanying drawings.

Figure 1:
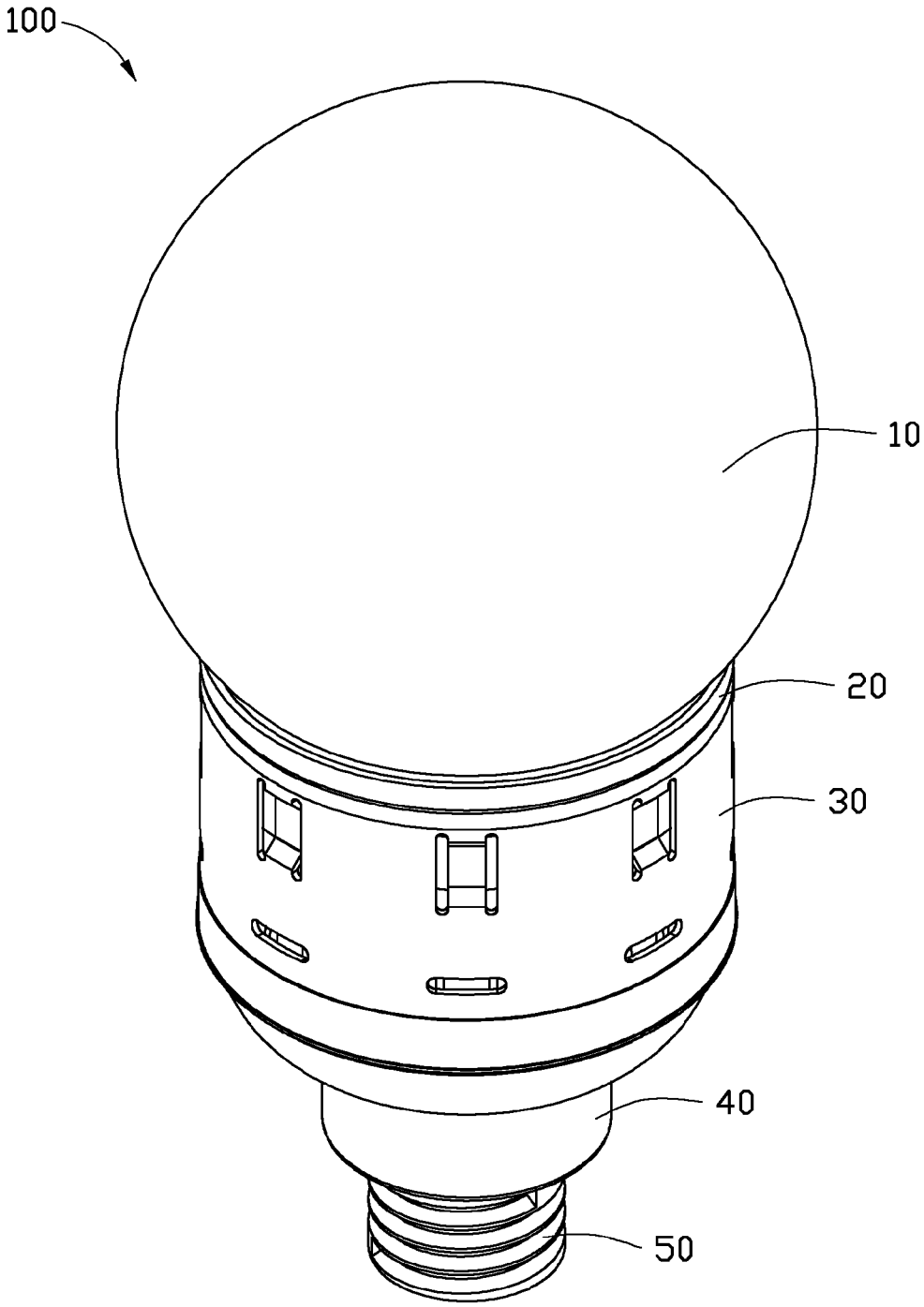
FIG. 1 is an isometric view of an LED illuminating device in accordance with an exemplary embodiment.

Referring to FIG. 1, an embodiment of an LED illuminating device 100 is illustrated. The device 100 includes a bulb 10, a base plate 20, a housing 30, a base 40, and a connector 50. The bulb 10 is fixed on the base plate 20. The base plate 20 is connected to the housing 30. The housing 30 and the connector 50 are respectively attached to two opposite ends of the base 40. The connector 50 is used to connect to a coupling connector to electrically connect the device 100 to a power source.

Figure 2:
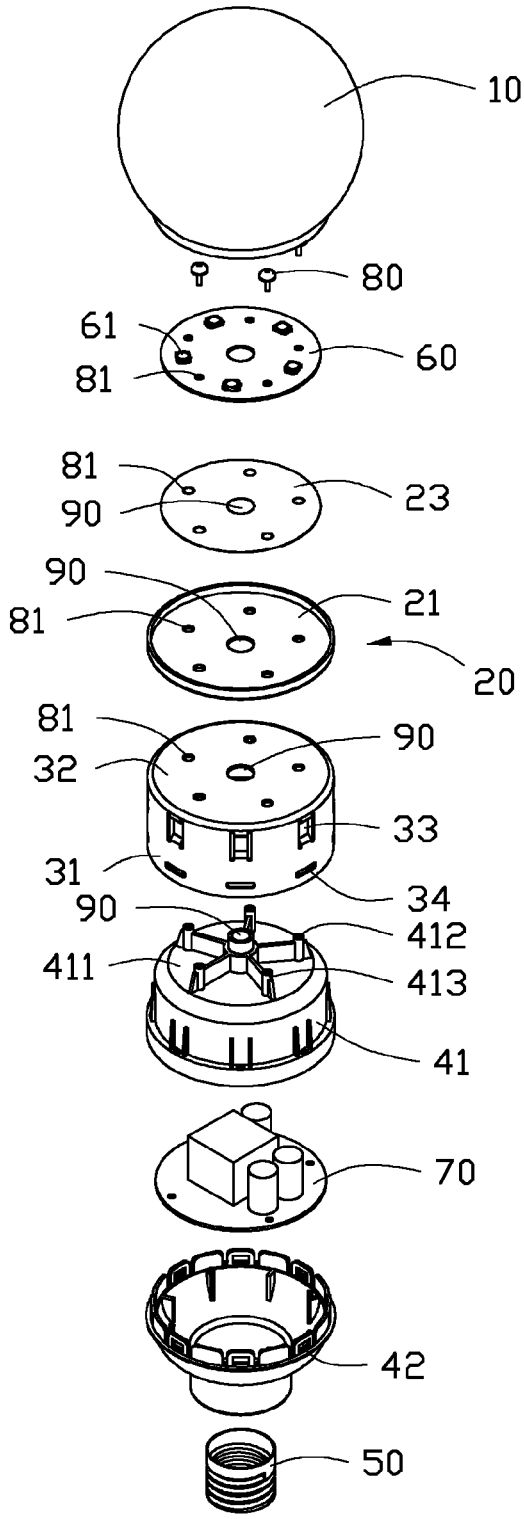
FIG. 2 is an isometric, exploded view of the LED illuminating device of FIG. 1.

Referring to FIG. 2, the device 100 further includes an LED substrate 60, a heat-conductive medium 23, and a driving circuit 70. A number of LEDs 61 are arranged on the LED substrate 60. The driving circuit 70 is electrically connected to the connector 50 and the LED substrate 60.

In this embodiment, the base plate 20 is made of metal with good heat conductivity, such as copper or aluminum, and is shaped like a flat disc. In another embodiment, the base plate 20 can be made of ceramic. A recess 21 is formed in the top surface of the base plate 20 for receiving the LED substrate 60. The bulb 10 is connected to the base plate 20. The heat-conductive medium 23 is a graphite sheet arranged between the LED substrate 60 and the top surface of the base plate 20, for transferring the heat generated by the LEDs 61 from the LED substrate 60 to the base plate 20. In other embodiments, the heat-conductive medium 23 can be heat-conductive glue or heat-conductive ceramic. A heat-conductive material is arranged between the gap of the LED substrate 60 and the sidewall of recess 21 to improve the heat-conductive efficiency of the LED illuminating device 100.

Figure 3:
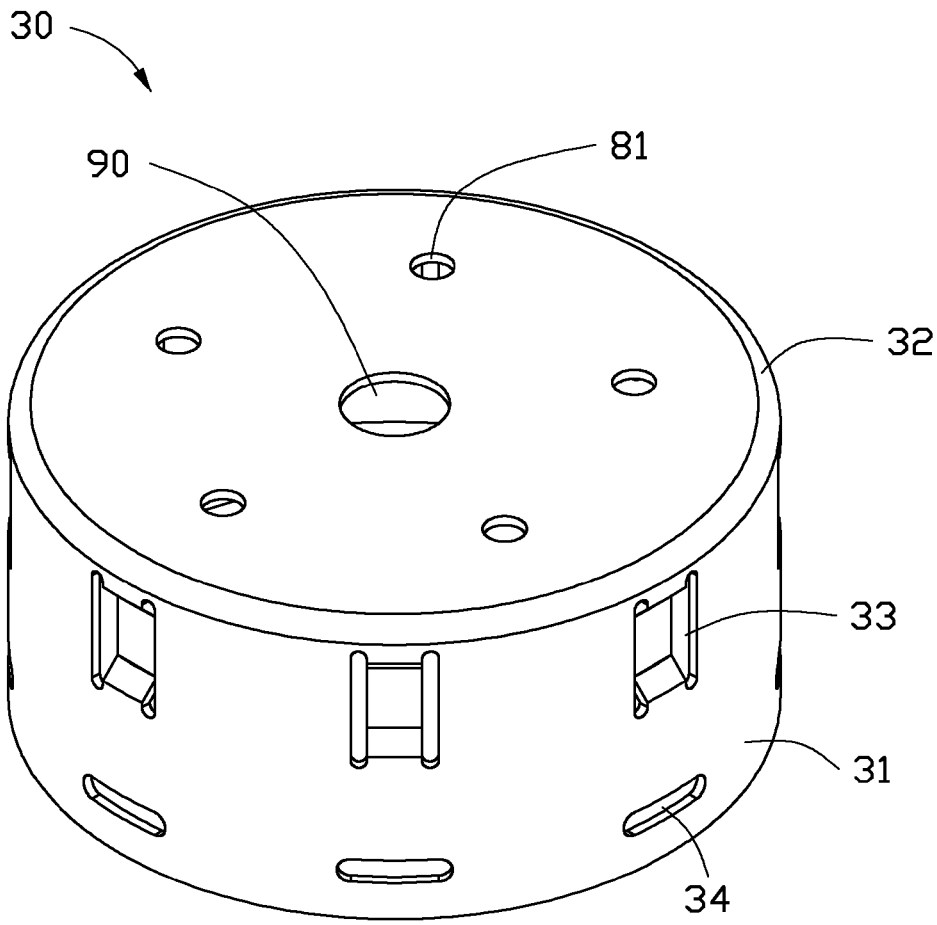
FIG. 3 is a schematic view of a housing of the LED illuminating device of FIG. 1.

Referring to FIGS. 2 and 3, the housing 30 is made of metal with good heat conductivity, such as copper or aluminum, and is cylindrical. The housing 30 includes an open end 31 and a closed end 32 opposite to the open end 31. The base plate 20 is fixed on the closed end 32 of the housing 30. A number of first vents 33 are arranged in the lateral surface of the housing 30 adjacent to the closed end 32. A number of second vents 34 are arranged in the lateral surface of the housing 30 adjacent to the open end 31.

The base 40 includes an upper base 41 and a bottom base 42. The upper base 41 and the bottom base 42 are both made of electrically insulating material, such as plastic materials. A number of connecting posts 413 protrude from the top surface 411 of the upper base 41, and each define a threaded hole 412. Several sets of through holes 81 are correspondingly defined in the LED substrate 60, the heat-conductive medium 23, the base plate 20, and the closed end 32 of the housing 30. Fastening means, such as screws 80 extend through the through holes 81 and are screwed into the threaded holes 412 of the connecting posts 413, thereby fixing the LED substrate 60, the heat-conductive medium 23, the base plate 20, the housing 30, and the upper base 41 together.

Figure 4:
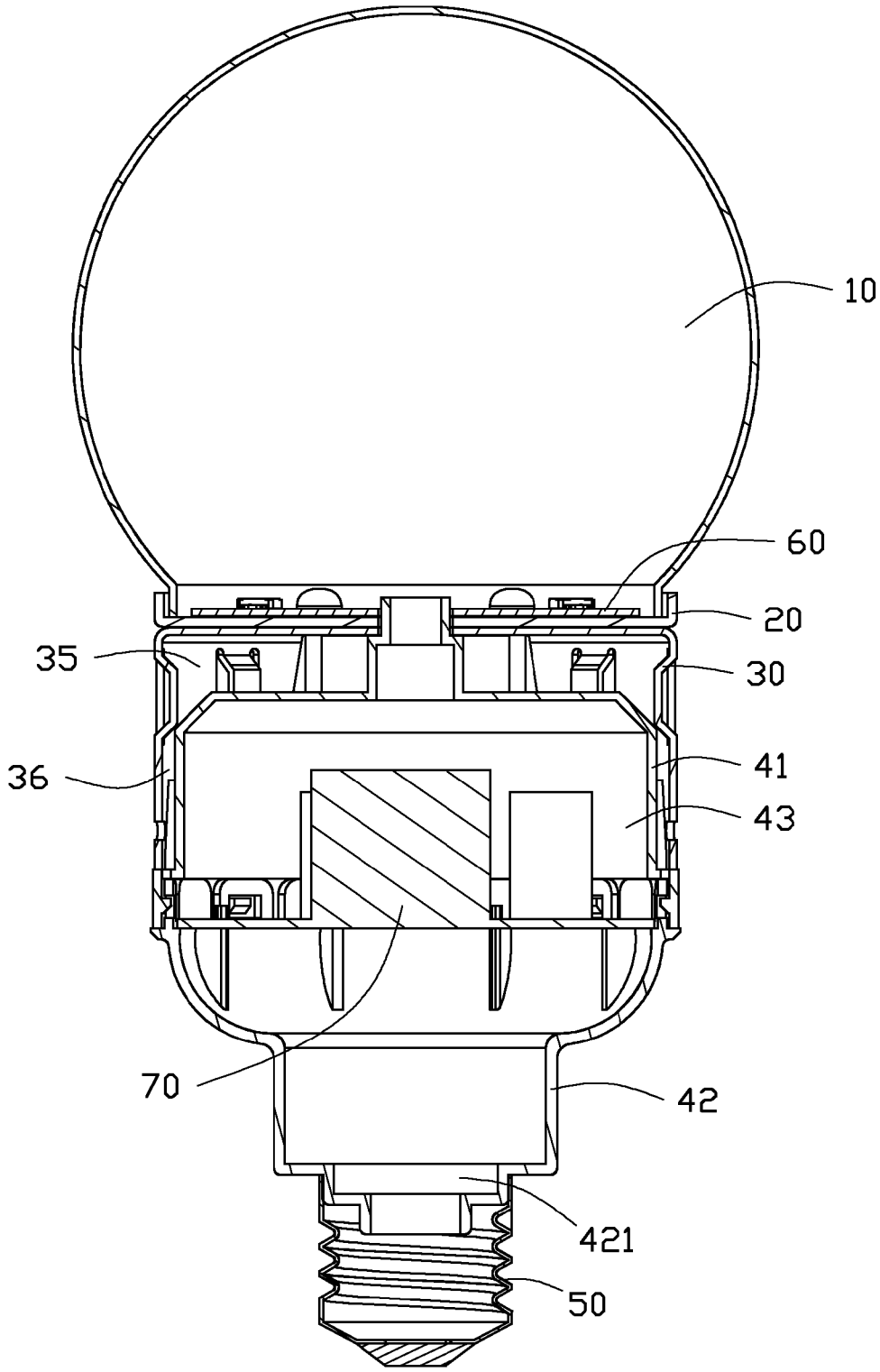
FIG. 4 is a schematic, cross-sectional view of the LED illuminating device of FIG. 1.
Figure 5:
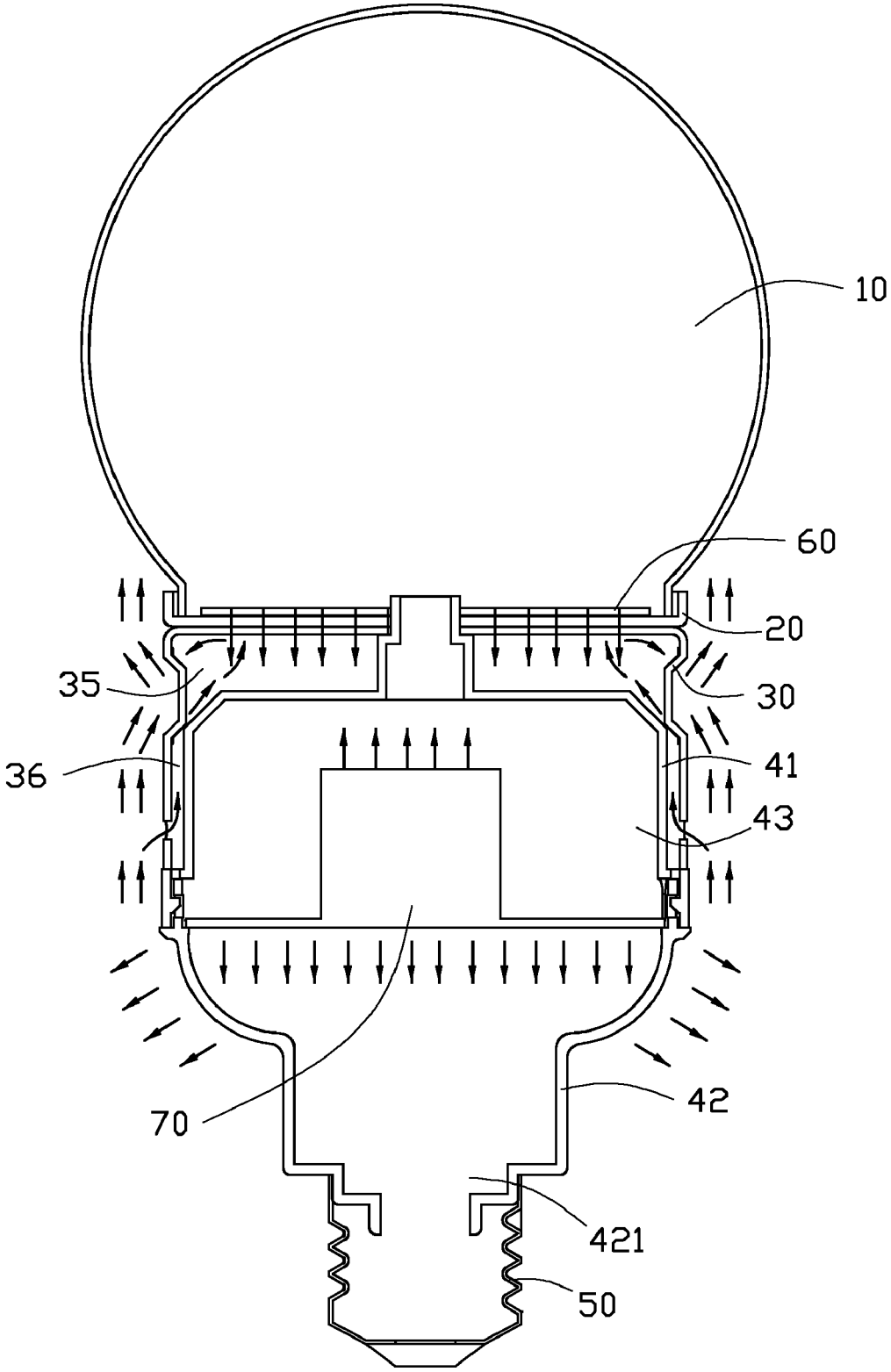
FIG. 5 is a schematic view showing a heat dissipation pattern of the LED illuminating device of FIG. 1.

Referring to FIGS. 2 and 4, in this embodiment, the upper base 41 is fixed to the bottom base 42 by the engagement of tabs (not labeled). A space 43 is formed between the upper base 41 and the bottom base 42 for accommodating the driving circuit 70. In other embodiments, the upper base 41 can be connected to the bottom base 42 by fasteners, such as screws. Several sets of through holes 90 are correspondingly formed in the heat-conductive medium 23, the base plate 20, the closed end 32 of the housing 30, and the upper base 41, allowing wires connecting the LED substrate 60 and the driving circuit 70 to extend through. The bottom base 42 is connected to the connector 50 and defines a through hole 421 for allowing the wires connecting the connector 50 to the driving circuit 70 to extend through.

The upper base 41 is held inside the housing 30. The external diameter of the upper base 41 is less than the internal diameter of the housing 30, so as to form a gap 36 between the lateral wall of the upper base 41 and the inside wall of the housing 30. Because of the connecting posts 413 on the top surface 411 of the upper base 41, a space 35 is formed between the top surface of the upper base 41 and the closed end 32 of the housing 30. The space 35 and the gap 36 communicate with the first vents 33 and the second vents 34.

Referring to FIG. 4, the heat generated by the LED substrate 60 is transferred to the housing 30 via the base plate 20, and finally transferred outside of the housing 30. The space 35 and the gap 36 serve as a hot air path to promotes heat exchange between hot air in the housing 30 and cool air outside the housing 30. The hot air exits the LED illuminating device 100 from the first vents 33. The cool air enters the space 35 and the gap 36 from the second vents 34. The cool air cools the LED illuminating device 100 by heat exchanging with the lateral wall of the upper base 41 and the inside wall of the housing 30, thus promoting the cooling efficiency.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED illuminating device, comprising:

a housing comprising an open end and a closed end opposite to the open end;

an LED substrate mounted on the closed end of the hollow housing and comprising a plurality of LEDs;

a connector configured to electrically connect the LED illuminating device to a power source;

a base held inside the housing; and a driving circuit accommodated in the base;

wherein a plurality of first vents are defined in the lateral surface of the housing adjacent to the closed end, a plurality of second vents are defined in the lateral surface of the housing adjacent to the open end, a space is formed between the surface of the base and the inner wall of the housing, and the space communicates with the first vents and the second vents.

2. The LED illuminating device according to claim 1, further comprising a base plate arranged between the LED substrate and the housing, wherein the LED substrate is fixed on the base plate.

3. The LED illuminating device according to claim 2, wherein the base plate is made of metal or ceramic.

4. The LED illuminating device according to claim 2, wherein a heat-conductive medium is arranged between the LED substrate and the top surface of the base plate for transferring heat generated by the LEDs from the LED substrate to the base plate.

5. The LED illuminating device according to claim 4, wherein the heat-conductive medium is a graphite sheet, heat-conductive glue or heat-conductive ceramic.

6. The LED illuminating device according to claim 2, wherein a recess is formed in the top surface of the base plate for receiving the LED substrate.

7. The LED illuminating device according to claim 1, wherein the base comprises an upper base and a bottom base, a space is formed between the upper base and the bottom base to accommodate the driving circuit.

8. The LED illuminating device according to claim 7, wherein a plurality of connecting posts protrude from a top surface of the upper base, a plurality of sets of through holes are correspondingly formed in the LED substrate and the closed end of the housing, fastening means extend the through-hole and engage to the connecting post to fix the LED substrate, the housing and the upper base together.

* * * * *